US006977333B2

(12) United States Patent
Sutej

(10) Patent No.: US 6,977,333 B2
(45) Date of Patent: Dec. 20, 2005

(54) REMOTE HI-HAT APPARATUS OPERATED BY THE FOOT PEDAL OF THE FIRST HI-HAT APPARATUS

(75) Inventor: Anton Sutej, Duga Resa (HR)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 10/505,945

(22) PCT Filed: Mar. 4, 2002

(86) PCT No.: PCT/HR02/00011

§ 371 (c)(1),
(2), (4) Date: Aug. 25, 2004

(87) PCT Pub. No.: WO03/081571

PCT Pub. Date: Oct. 2, 2003

(65) Prior Publication Data

US 2005/0150355 A1 Jul. 14, 2005

(51) Int. Cl.[7] ..... G10D 13/02
(52) U.S. Cl. ..... 84/422.3; 84/422.1; 84/422.2
(58) Field of Search ..... 84/422.1, 422.2, 84/422.3

(56) References Cited

U.S. PATENT DOCUMENTS 5,267,500 A * 12/1993 Lombardi ..... 84/402
5,438,903 A * 8/1995 Cropek ..... 84/422.3

* cited by examiner

*Primary Examiner*—Kimberly Lockett
(74) *Attorney, Agent, or Firm*—William W. Haefliger

(57) ABSTRACT

Remote wire hi-hat apparatus is actuated by the pedal of the first hi-hat apparatus via flexible cable. A lever connecting the foot pedal of the master hi-hat and the flexible cable of the slave hi-hat is fixed to the pedal by a screw used to attach a chain or belt connected to the elevator rod of the master hi-hat. The flexible cable is connected to the lever by means of ring-shaped attachment unit. Housing of the sheath of the flexible cable is at the lower part of the hollow post of the master hi-hat stand. At the other end of the flexible cable there is a hollow post of the slave hi-hat. In the hollow post of the slave hi-hat there is a spring used to return the cable to the starting position. To achieve that the foot pedal is to be worked with the same force there are springs with hollow screws and nuts placed between top and bottom cymbals of both master and slave hi-hats. Instead of the said lever there can be a set of two pulleys placed between foot pedal and elevator rod of the master hi-hat.

8 Claims, 5 Drawing Sheets

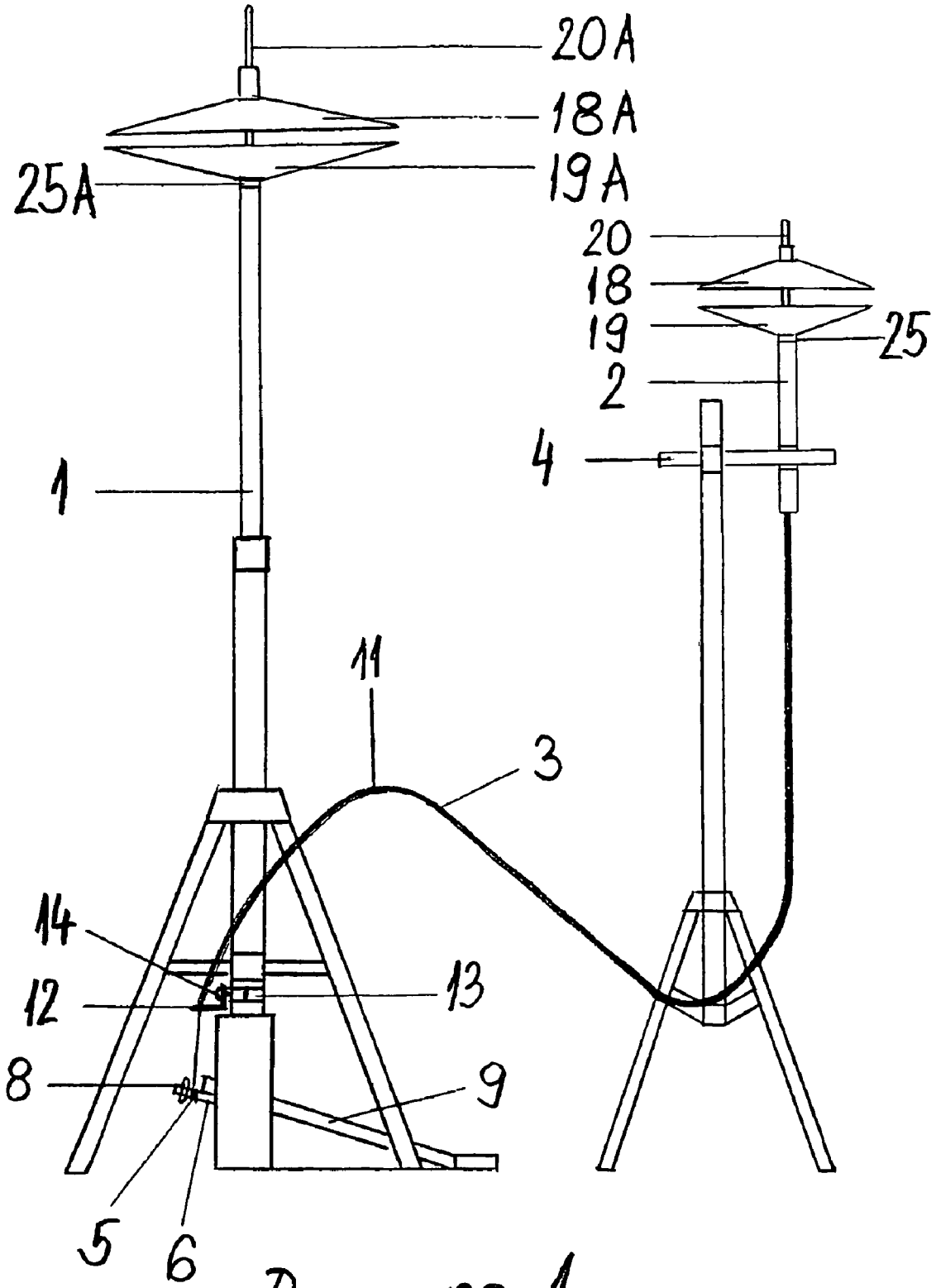
Drawing 1

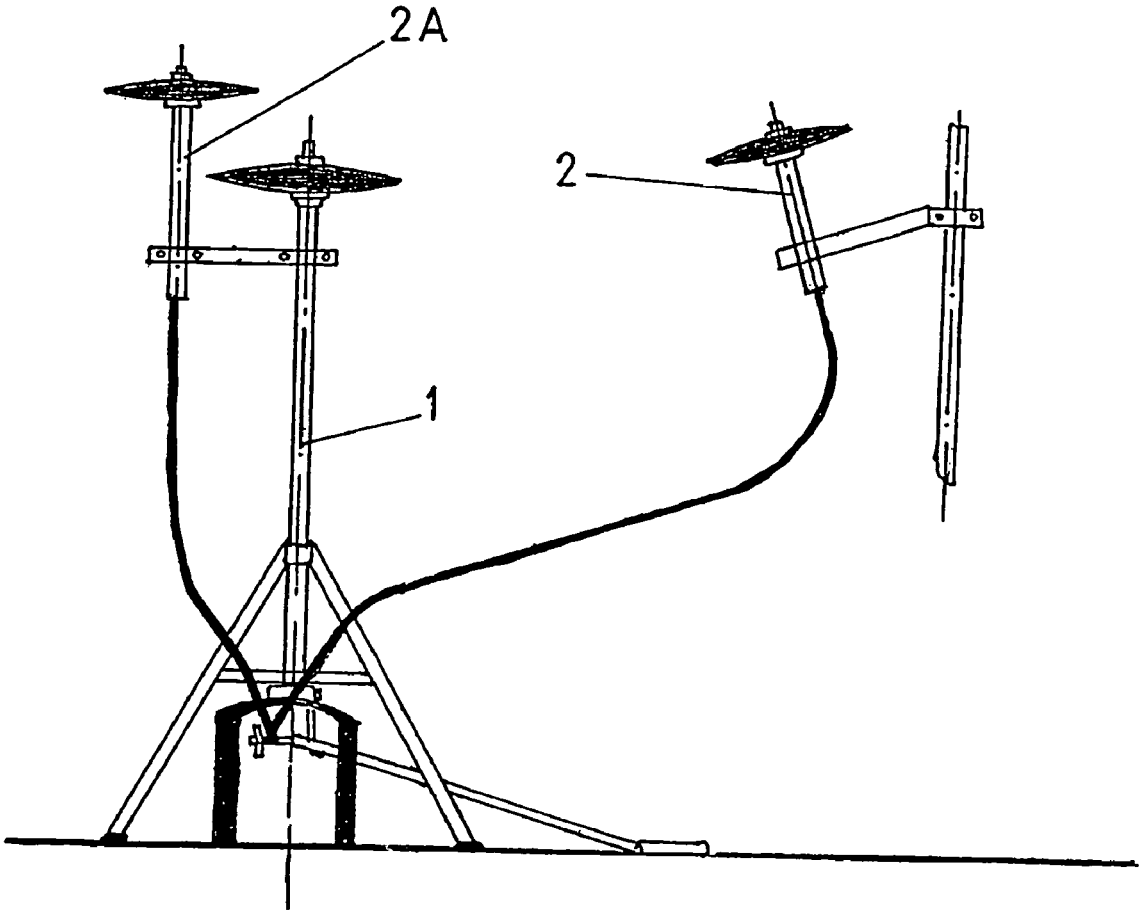
Drawing 2

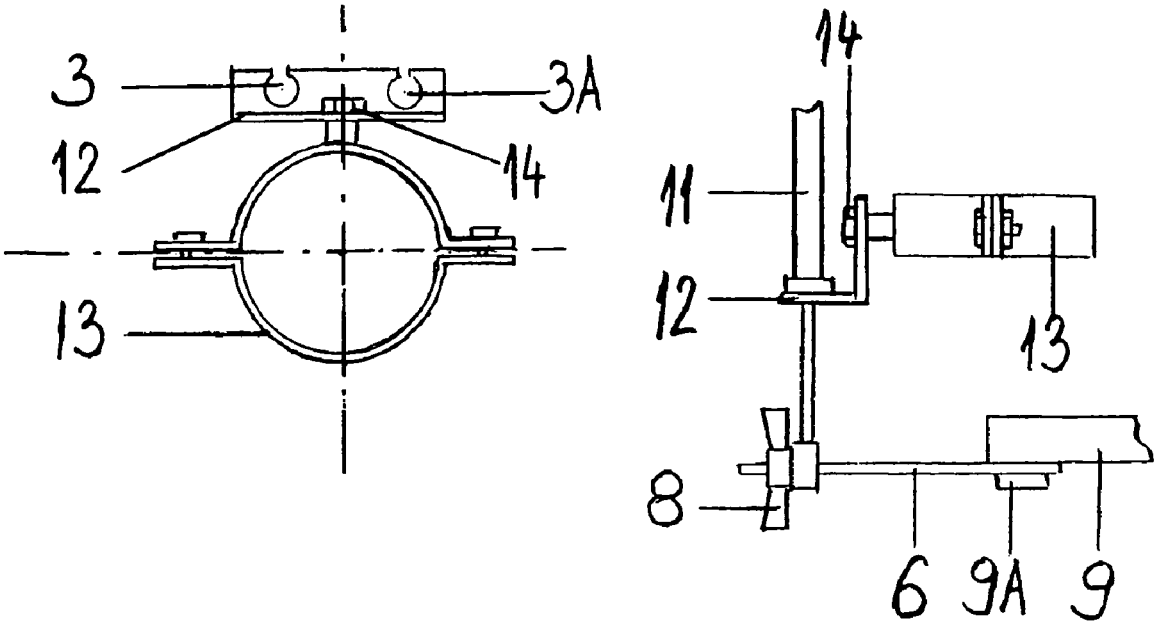
Drawing 3
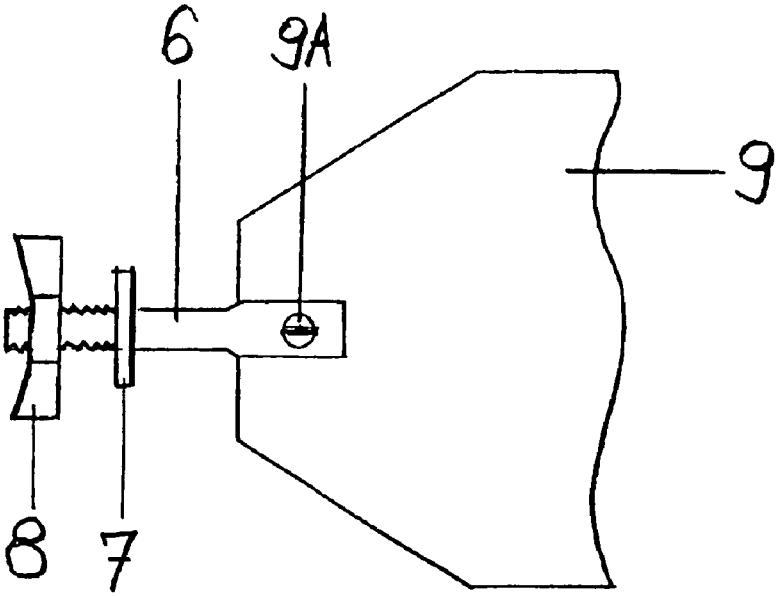
Drawing 4

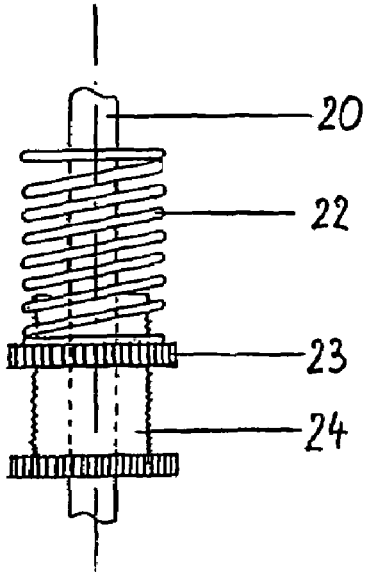
Drawing 5
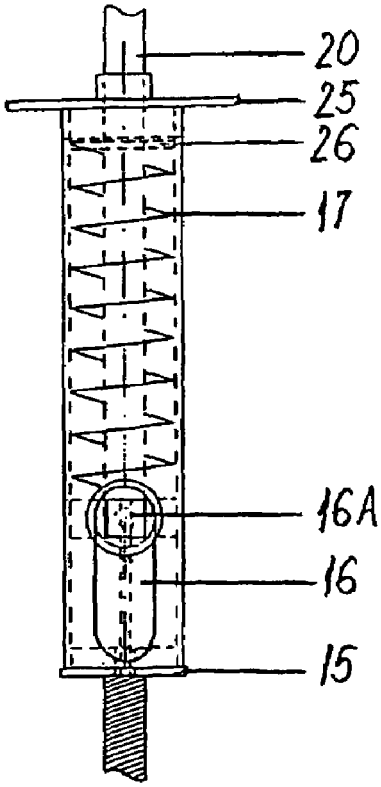
Drawing 6

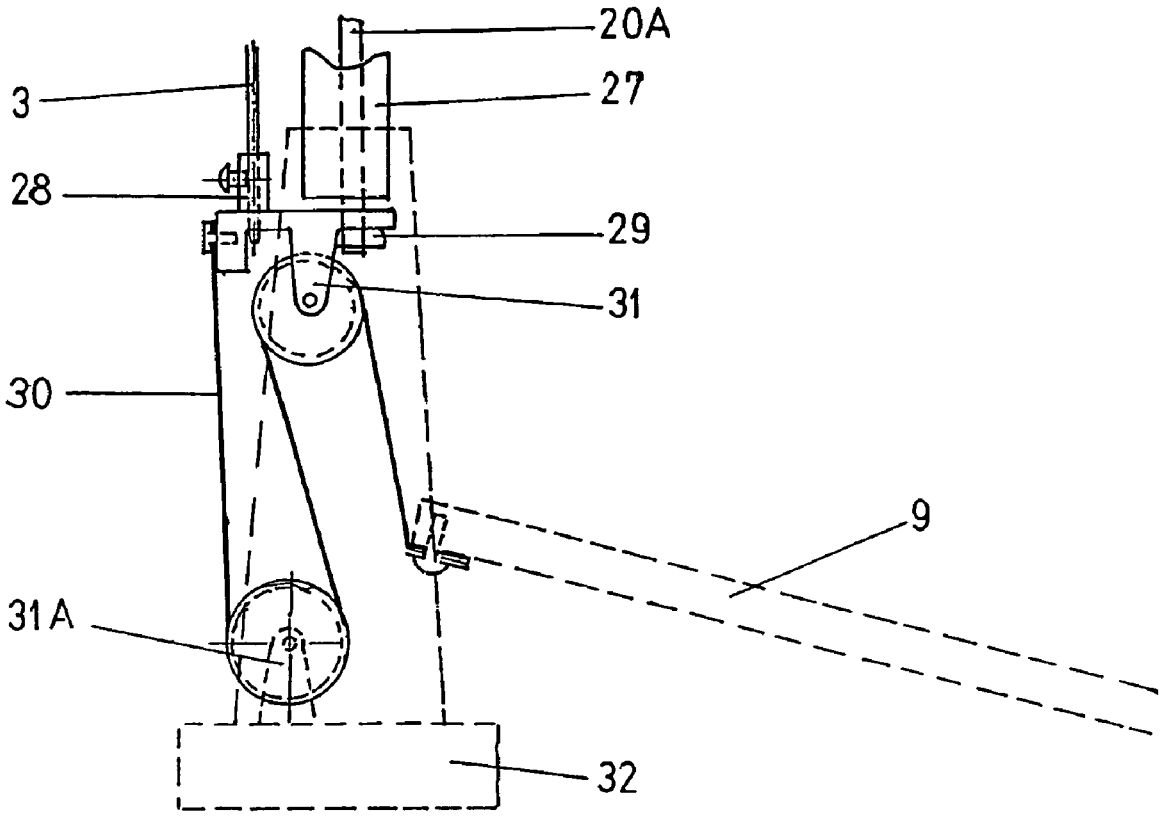
Drawing 7

REMOTE HI-HAT APPARATUS OPERATED BY THE FOOT PEDAL OF THE FIRST HI-HAT APPARATUS

BACKGROUND OF THE INVENTION

1. Field of the Invention

This invention relates generally to improvements of remote hi-hat apparatus, and more particularly to using the foot pedal of the first (master) hi-hat to operate the remote (slave) hi-hat.

2. Description of the Related Art

In the constantly growing and evolving art of modern drumming there is a trend to use remote wire hi-hats besides the standard hi-hat in a drum set.

In that case each hi-hat apparatus has its own foot pedal. Some drummers use the remote hi-hat and play it using only sticks, without the foot pedal. If they want to use the remote hi-hat which has its own pedal and flexible cable for transmission they have to shift their foot from one pedal to another and that can be rather confusing and restricting for the performance.

SUMMARY OF THE INVENTION

The objective of this invention is to make playing drums easier by using the foot pedal of the first (master) hi-hat to operate the remote (slave) hi-hat, and by saving space and movements to enable drummers greater speed and versatility of playing.

In order to achieve the above object, a hi-hat stand apparatus associated with remote hi-hat apparatus according to the present invention comprises:

master hi-hat apparatus and remote (second) hi-hat apparatus operated (opened and closed) via flexible cable;

second hi-hat being fixed by clamps to a cymbal stand or some other stand placed opposite to the master hi-hat in a drum set, or as preferred by the player;

flexible cable used for transmission connecting the foot pedal of the master hi-hat and the elevator rod of the slave hi-hat;

the flexible cable having ring-shaped attachment unit at its one end fixed to the lever next to retainer and a wingnut to secure the ring-shaped attachment unit;

lever fixed to the foot-pedal unit of the master hi-hat by a screw used to attach a chain or belt connected to the elevator rod of the upper cymbal of the master hi-hat;

one end of the lever being flattened and having a hole in it put under the screw of the chain or belt;

sheath of the flexible cable being fixed to the housing; the housing attached to the two part clamp by a screw;

the two-part clamp being fixed to the lower part of the hollow post of the master hi-hat stand;

at the other end of the flexible cable there is a hollow post with a bottom cymbal of the slave hi-hat mounted on it;

on the other end of the post being a housing of the cable;

the lower portion of the post, next to the housing of the cable, having a longitudinal slot with spring constant adjusting unit sliding in it;

return spring being inside the hollow post used to return the cable to the starting position;

there being additional possibility to connect the third hi-hat and operate it by the foot pedal of the master hi-hat in the same way described before with the difference that the cable of the third hi-hat is fixed to the foothold which in this case has two housings.

According to the present invention the foot-pedal of the main hi-hat is used to operate (close or open) the second or even the third hi-hat. By the security clutch attached to the top cymbal we can fasten all three, only two, or only one hi-hat. In order to achieve that the foot-pedal is to be worked with the same force, in all three hi-hats there is a spring with hollow screw and a nut placed between the top and the bottom cymbal. The spring with the hollow screw and a nut is used to control the spring tension.

There is additional possibility to make the foot pedal even easier to work (for example if we operate three hi-hats): instead of the said lever there being a set of pulleys fixed between the pedal and elevator rod of the master hi-hat.

Additional objects and advantages of the invention will be set forth in the description which follows, and in part will be obvious from the description, or may be learned by practice of the invention. The objects and the advantages of the invention may be realized and obtained by means of instrumentality and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiment given below, serve to explain the principles of the invention.

FIG. 1 perspective view of a master hi-hat and remote hi-hat apparatus connected with flexible cable FIG. 2 master hi-hat with second and third hi-hats attached FIG. 3 housing of the second and the third hi-hat FIG. 4 lever attached to the foot-pedal of the master hi-hat FIG. 5 spring and the hollow screw with the nut FIG. 6 the holder of the second and the third hi-hat's cymbals FIG. 7 set of two pulleys placed between foot pedal and elevator rod of the master hi-hat

DETAILED DESCRIPTION OF THE PREFERRED EMBODIMENTS

One embodiment of the present invention will now be described with reference to the accompanying drawings of FIGS. 1 to 6.

A hi-hat cymbal instrument 1 shown in FIG. 1 comprises a hi-hat stand apparatus and a pair of cymbals 18*a* and 19*a* arranged at the upper portion of the apparatus. The second hi-hat 2 is fixed by clamps 4 to the cymbal stand 21. Flexible cable 3 used for transmission connects the foot-pedal 9 of the master hi-hat and the elevator rod 20 of the slave hi-hat 2.

There is a ring shaped attachment unit 5 at one end of the flexible cable 3 and it is fixed to the lever 6 next to the retainer 7. A wingnut 8 is put to unit 5 to secure it. The lever 6 is attached to the foot-pedal 9 of the master hi-hat by a screw 9*a* which is used to attach a chain or belt 10 that is connected to the elevator rod 20*a* of the upper cymbal of the master hi-hat.

One end of the lever 6 is flattened and has a hole on it. This end is placed under the screw 9*a* which normally fixes the chain or belt as shown in FIG. 4.

The other end of the lever 6 has a retainer 7 and a screw at the end. The sheath 11 of 3 has a housing 12 placed on the two part clamp 13 fixed by a screw 14 as shown in FIG. 3. Unit 13 is fixed to the lower part of the hollow post of the master hi-hat stand.

The other end of the sheath of the flexible cable 3 has its housing 15 at the hollow post with a bottom cymbal of the slave hi-hat mounted on it. At the lower portion of the post, next to 15, there is a longitudinal slot 16 with spring constant adjusting unit 16*a* sliding in it.

Inside the post there is a spring 17 as shown in FIG. 6 used to return the cable to the starting position.

FIG. 3 shows how we can apply this invention and connect one additional hi-hat, so that we have three hi-hats apparatus in a set. The third hi-hat 2*a* is connected to the foot pedal 9 of the master hi-hat in the same way as the second hi-hat, but in this case the cable of the third hi-hat is fixed to the foothold which has two housings 12 as shown in FIG. 3.

In order to enable that the foot pedal is worked softly, and that the upper cymbal is able to return quickly, no matter how many hi-hats are fastened (turned on) or loosened (turned off) (we turn the hi-hats on and off by means of security clutch) there should be a hollow screw 24 with a nut 23 and a spring 22 as shown in FIG. 5, placed between top and bottom hi-hat cymbals of both master and slave hi-hats. The nut 23 is used to adjust the spring tension which depends on the size of the cymbals we use.

To make the foot pedal even easier to work there can be a set of pulleys built in between the foot pedal and the elevator rod of the master hi-hat. A link with a pulley 31 is fixed by a nut 29 to the elevator rod 20*a* Flexible cable 3 (and 3*a*) is then fixed to 31. The other pulley is fixed to the lower portion of the frame 32 of the hi-hat stand. One end of chain or belt 30 is attached to link 31, while the other end, one which is guided over the pulley is fixed to the foot pedal of the master hi-hat, as shown in FIG. 7.

According to this description of the preferred embodiment of the present invention the improvement in drum playing becomes obvious: by actuating one foot pedal a drummer closes (or opens) both master and slave hi-hat at the same time, or only the first, only the second, whatever he or she prefers.

Additional advantages and modifications will readily occur to those skilled in the art. Therefore, the invention in its broader aspects is not limited to the specific details, and respective devices shown and described herein. Accordingly, various modifications may be made without departing from the spirit or scope of the general inventive concept as defined by the appended claims and their equivalents.

What is claimed is:

1. Apparatus for remotely operating first hi-hat cymbals and a foot pedal associated with said first hi-hat cymbals, and said second hi-hat cymbals comprising in combination a) a foot operated actuator for operating said first hi-hat cymbals, and said second hi-hat cymbals b) a flexible cable, having opposite ends, c) one end of the cable coupled to the actuator proximate a base stand structure supporting said first hi-hat said and second hi-hat cymbals, to displace the cable endwise, in one direction as the actuator actuates said first hi-hat, d) the opposite end of the cable operatively connected to support said the second hi-hat cymbals, e) and urging means operatively connected to said cable to yieldably urge the cable endwise, in the opposite direction.

2. The combination of claim 1 wherein the urging means comprises a spring.

3. The combination of claim 2 wherein said spring is operatively connected to said opposite end of the cable.

4. The combination of claim 1 wherein the actuator comprises a foot actuated pedal which is hingedly supported.

5. The combination of claim 1 wherein the actuator comprises two pulleys positioned between the first pedal and an elevator rod that is operatively connected to the first hi-hat.

6. The combination of claim 2 including means to adjust the tension of the spring.

7. The combination of claim 6 wherein said means includes an adjusting nut exerting force on the spring.

8. The combination of claim 1 including adjustable spring means acting on one of the cymbals of one of the hi-hats, to adjust the clashing of said cymbals.

* * * * *